US010758455B2

(12) United States Patent
Fisher et al.

(10) Patent No.: US 10,758,455 B2
(45) Date of Patent: Sep. 1, 2020

(54) PILLS DISPENSING DEVICE

(71) Applicants: Eric Fisher, New York, NY (US); Matthew J Curtin, Ossian, IN (US)

(72) Inventors: Eric Fisher, New York, NY (US); Matthew J Curtin, Ossian, IN (US)

( * ) Notice: Subject to any disclaimer, the term of this patent is extended or adjusted under 35 U.S.C. 154(b) by 0 days.

(21) Appl. No.: 15/343,200

(22) Filed: Nov. 3, 2016

(65) Prior Publication Data

US 2017/0049662 A1 Feb. 23, 2017

Related U.S. Application Data

(60) Provisional application No. 62/250,473, filed on Nov. 3, 2015.

(51) Int. Cl.
*A61J 7/00* (2006.01)

(52) U.S. Cl.
CPC ..... *A61J 7/0076* (2013.01); *A61J 7/0084* (2013.01); *A61J 2205/70* (2013.01)

(58) Field of Classification Search
CPC ..... A61J 7/0076; A61J 2205/70; B65D 50/00; B65D 83/0427; B65D 83/0445; B65D 83/0454; B65D 83/049
See application file for complete search history.

(56) References Cited

U.S. PATENT DOCUMENTS 3,991,908 A * 11/1976 Thomas ..... B65D 83/0409 215/218
4,653,668 A * 3/1987 Gibilisco ..... B65D 83/0409 206/540
5,085,331 A * 2/1992 Groya ..... B65D 47/0847 215/235
5,158,180 A * 10/1992 Zucker ..... A47K 10/3818 206/210
5,791,515 A * 8/1998 Khan ..... B65D 83/0409 206/533
7,147,130 B1 * 12/2006 Clark ..... B65D 83/0427 221/147
8,579,140 B2 * 11/2013 Delagrange ..... B65D 41/06 215/221
9,492,356 B2 * 11/2016 Balakier ..... A61J 7/04
2005/0029154 A1 * 2/2005 Kahn ..... A61J 7/0076 206/540

(Continued)

*Primary Examiner* — Gene O Crawford
*Assistant Examiner* — Kelvin L Randall, Jr.
(74) *Attorney, Agent, or Firm* — Barry Choobin; Patent 360

(57) ABSTRACT

The embodiments herein provide a device for dispensing pills. The device comprises several dispensing chambers molded into the bottle rim, or fastened inside or outside the bottle. The chamber includes many radial projections defining discrete pill holding areas. The device comprises a dispensing cap secured and rotated uni-directionally or bi-directionally to the chambers, having a base, provided with a window. The cap comprises uneven surfaces on the holding surface to allow the pills in the chambers to oscillate up and down thereby causing a mixing action. The cap is mounted outside the bottle. The device further comprises a rotating central hub formed on an inner side of the base for delimiting an inner boundary of the pill holding areas. The cap is rotated to align the window with the pill holding areas to dispense a pill when the bottle is inverted or angled upside-down.

8 Claims, 8 Drawing Sheets

(56) References Cited

U.S. PATENT DOCUMENTS

| | | | | |
|---|---|---|---|---|
| 2008/0251531 | A1* | 10/2008 | Coe | B65D 83/0454 221/265 |
| 2015/0014269 | A1* | 1/2015 | Gillman | B65D 50/041 215/206 |
| 2015/0151898 | A1* | 6/2015 | Desset-Brethes | B65D 83/04 221/1 |

* cited by examiner

PILLS DISPENSING DEVICE

BACKGROUND

Technical Field

The embodiments herein are generally related to the field of containers or packages with special means for dispensing. The embodiments herein are particularly related to pill, capsule, tablet, caplet, and bulk powder or granulated supplement (all hereinafter collectively called as "pill" or "pills") containers for dispensing by individuals. The embodiments herein are more particularly related to a single dose bottle cap that is attached to or integrated with a pill container for dispensing in uni-direction or bi-direction depending on the preference/usage.

Description of the Related Art

Pill containers and dispensers have existed for quite some time. Generally, they comprise a bottle-like holding compartment with a removable cap. The container is initially provided with a large number of doses of the pills and the consumer desirably dispenses to himself or herself one or two of the pills at a time. Often, and recently, the caps to such containers have been provided with safety mechanisms so that children is prevented to inadvertently or accidentally gain access to the pills contained in the bottle to avoid ingesting a number of the pills that leads to harmful effects on children or to prevent taking a overdose of pills than that prescribed.

Many safety mechanisms have been developed over recent years. A major drawback of the conventional pill containers, and even the conventional safety caps for same, is that once the bottle/cap is opened, the user has access to all of the pills inside whether he/she wants such access or not. These existing versions of the pill containers involve a chamber component that is mounted inside the bottle with a friction fit while the cap is snapped onto a "Calmar" type of standard bottle. The calmer fit used here is little outdated and is used less frequently in recent times. This design does not allow for a hermetic foil seal to be attached to the bottle mouth opening. Thus, these containers do not provide an airtight seal for the long term holding of pills/capsules. The hermetic seal is critical for shelf-life and for shipping of the pills. Also, the existing version of the pill containers/dispensers does not have a seal between the outer cap and the chamber component. Obviously, the lack of a seal allows air and moisture elements to degrade the product contained inside.

Moreover, the existing versions of the pill dispensers only allow for dispensing of the pills in one direction. These containers utilize a living hinge that is 180 degrees opposite of the dispensing orifice. The 180 degree opposing hinge does not have the ability to hold the lid in open position which becomes very inconvenient at times. Further, the existing pill dispensers make use of a perimeter lock detent which does not provide a real tactile feel for when the rotation is complete which results into user over-rotating the cap and dispensing more than what they need. The perimeter detents also do not effectively inhibit counter-rotation or rotation in the opposite direction. Additionally, the existing versions do not have any method to induce a mixing/turbulent action to cause pills to fall into each chamber.

Hence, there is a need for a pill dispensing device which facilitates dispensing of the pills in uni-direction or bi-direction depending on the preference/usage. Further, there is a need for a pill dispensing device providing a hermetic seal for long term storage and shipping of pills. Yet there is a need for a pill dispensing device with ability to hold the cover/lid in open position while dispensing. Yet there is a need for a pill dispensing device that is easy to mate with widely used bottle/container types and is less expensive to manufacture.

The above mentioned shortcomings, disadvantages and problems are addressed herein and which will be understood by reading and studying the following specification.

OBJECTS OF THE EMBODIMENTS

The primary object of the embodiments herein is to provide a pill dispensing device that is attached to or integrated with a pill container for dispensing in uni-direction or bi-direction depending on the usage.

Another object of the embodiments herein is to provide a one-at-a-time pill (or dosage) dispensing device which is inexpensive to manufacture and which is made either as a retrofit cap to existing bottles and containers or, in the alternative, as a new article of manufacture which is formed integrally with a bottle.

Yet another object of the embodiments herein is to provide a pill dispensing device with a bisecting hinge or a butterfly hinge to have or provide a smaller lid profile and allow the lid to be partially open while dispensing.

Yet another object of the embodiments herein is to provide a pill dispensing device with a low resistance child proof mechanism to prevent a child from gaining access to the entire contents of the bottle.

Yet another object of the embodiments herein is to provide a pill dispensing device with a safety mechanism which requires adult-like manual dexterity to override so that the overall medication container is child-resistant.

Yet another object of the embodiments herein to provide a pill dispensing device that is limited to dispense only a single pill (or dosage, which may be two pills) at a time, even when a child is managed to remove pills from the bottle, or access to one or more of the pills within the storage chamber.

Yet another object of the embodiments herein is to provide a pill dispensing device provided with a cap that is rotatable in either clockwise or counter-clockwise direction to facilitate the cap to be used with any standard bottle/container.

Yet another object of the embodiments herein is to provide a pill dispensing device to allow a dispensing of multiple pill forms that include tablets and caplets, geltabs and gelcaps with the same/single dispenser.

Yet another object of the embodiments herein is to provide a pill dispensing device to dispense tablets, capsules or powder in a hygienic way so that a single dose is provided without the potential contamination of the remaining contents of the bottle.

Yet another object of the embodiments herein is to provide a pill dispensing device provided with a butterfly hinge which in turn requires only two pieces in the steel mold resulting in less expensive production and also using less plastic material.

Yet another object of the embodiments herein is to provide a pill dispensing device with an outside mount to a Calmar or threaded standard bottle to achieve a hermetic seal on the bottle.

Yet another object of the embodiments herein is to provide a pill dispensing device which is easily affixed with a bottle containing one or more dispensing chambers.

Yet another object of the embodiments herein is to provide a pill dispensing device with enhanced hermetic seal for increasing the shelf-life of the pills and for shipping.

Yet another object of the embodiments herein is to provide a pill dispensing device with a continuous threaded cap which is easily removable with a traditional press and turn action.

Yet another object of the embodiments herein is to provide a pill dispensing device that is easy to mate with widely used bottle types and is less expensive to manufacture.

Yet another object of the embodiments herein is to provide a pill dispensing device with a vertical lock rotation ramps to achieve pronounced tactile feel when dispensing cap rotation is completed.

Yet another object of the embodiments herein is to provide a pill dispensing device with a vertical lock rotation ramps to make an audible click/tap sound and a vibration feel when the outer and inner caps are aligned to dispense.

Yet another object of the embodiments herein is to provide a pill dispensing device with a vertical lock rotation ramps to serve as interlocking teeth to engage while unscrewing the dispensing cap from the bottle during the press and turn action as part of a child safety system.

Yet another object of the embodiments herein is to provide a pill dispensing device with uneven surfaces on the dispensing cap's holding surface (vertical rotation lock ramps) that cause pills in the dispensing chambers to oscillate up and down to promote a mixing/turbulent action.

Yet another object of the embodiments herein is to provide a pill dispensing device with a bevelled edge seal rim around the inside of the dispensing cap/outer cap which is pressed into and against the dispensing chamber/inner cap's sealing sleeve/ridge to reduce exposure of the contents inside the container to air and moisture.

Yet another object of the embodiments herein is to provide a pill dispensing device with rotating central hub to the dispensing chambers to reduce a number of operating components or parts.

Yet another object of the embodiments herein is to provide a pill dispensing device which allows cotton to be used to reduce moisture in the bottle.

Yet another object of the embodiments herein is to provide a pill dispensing device with a preset geometric shape for the central hub to ensure that cotton does not enter/get into the dispensing chambers to prevent any fouling or pungent smell in the dispensing action thus avoiding use of a desiccant can.

Yet another object of the embodiments herein is to provide a pill dispensing device with simple two piece design as compared to existing versions having five to eight piece designs.

These and other objects and advantages of the embodiments herein will become readily apparent from the following detailed description taken in conjunction with the accompanying drawings.

SUMMARY

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

The various embodiments herein provide a device for dispensing pills. The device comprises one or more dispensing chambers configured for molding into the bottle rim, or fastening inside or outside of the bottle. The dispensing chamber includes a plurality of radial projections projecting inwardly from an inner circumference of the dispensing chamber. The radial projections define discrete pill holding areas. The pill dispensing device also comprises a dispensing cap secured to and rotated either uni-directionally or bi-directionally to the one or more dispensing chambers, having a base with a window formed there through. The window is selectively positioned opposite the pill holding areas. The dispensing cap comprises uneven surfaces on the cap's holding surface thereby providing the pills in the dispensing chambers to oscillate up and down to cause the mixing/turbulent action. The dispensing cap is mounted outside the bottle. The pill dispensing device further comprises a rotating central hub formed on an inner side of the base for delimiting an inner boundary of the pill holding areas. The dispensing cap is rotated to locate the window in alignment with successive pill holding areas. When the bottle is inverted or angled upside-down, a pill in one of the pill holding areas falls through the window when the window is positioned opposite to the pill holding areas.

According to an embodiment herein, the dispensing cap is provided with a bisecting hinge or a butterfly hinge to provide a lid with a smaller profile or to allow the lid to have a smaller lid profile and to partially open the lid during a dispensing action.

According to an embodiment herein, the hinge of the dispensing cap is attached either in the middle of the cap (living hinge) or directly opposite to the dispensing door (butterfly hinge).

According to an embodiment herein, the dispensing cap is provided with a low resistance child proof mechanism to prevent a child to gain access to the entire contents of the bottle.

According to an embodiment herein, the dispensing cap is rotated in either clockwise or counter-clockwise direction to facilitate the cap to be used with any standard bottle/container.

According to an embodiment herein, the dispensing cap is configured for dispensing multiple pill forms including tablets and caplets, geltabs and gelcaps and the like.

According to an embodiment herein, the dispensing cap is configured for mounting outside with a Calmar snap fit or by continuous thread to achieve a hermetic seal on the bottle.

According to an embodiment herein, the dispensing cap is provided with continuous threads for easy removal of the cap with a traditional press and turn action.

According to an embodiment herein, the dispensing cap is provided with vertical lock ramps to achieve a pronounced tactile feel when a cap rotation is completed and to provide an audible click/tap sound and a vibration feel when the outer and inner caps are aligned to dispense.

According to an embodiment herein, the dispensing cap comprises a beveled edge seal rim positioned around the inside of the outer cap which is pressed into and against the inner cap's sealing sleeve/ridge to reduce exposure of the contents inside the container to air and moisture.

According to an embodiment herein, the dispensing cap further comprises a cover hingedly attached to the base for covering the outside of the base and the window. The ambient air is substantially prevented from entering the bottle. The hinge is a bisecting hinge or a butterfly hinge.

According to an embodiment herein, the pill dispensing device comprises ratcheting ribs arranged inside the dispensing cap's rim that is configured to lock around the dispensing chamber when the dispensing cap is squeezed.

According to an embodiment herein, the dispensing chamber further comprises a plurality of claws respectively extending below the pill holding areas.

According to an embodiment herein, the pill to be dispensed is a measured dose of a loose powder or granulated substance.

According to an embodiment herein, the central hub is configured to be rotated inside the dispensing chamber to reduce the total number of parts/operating components in the pill dispensing device.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

BRIEF DESCRIPTION OF THE DRAWINGS

The other objects, features and advantages will occur to those skilled in the art from the following description of the preferred embodiment and the accompanying drawings in which.

Figure 1:
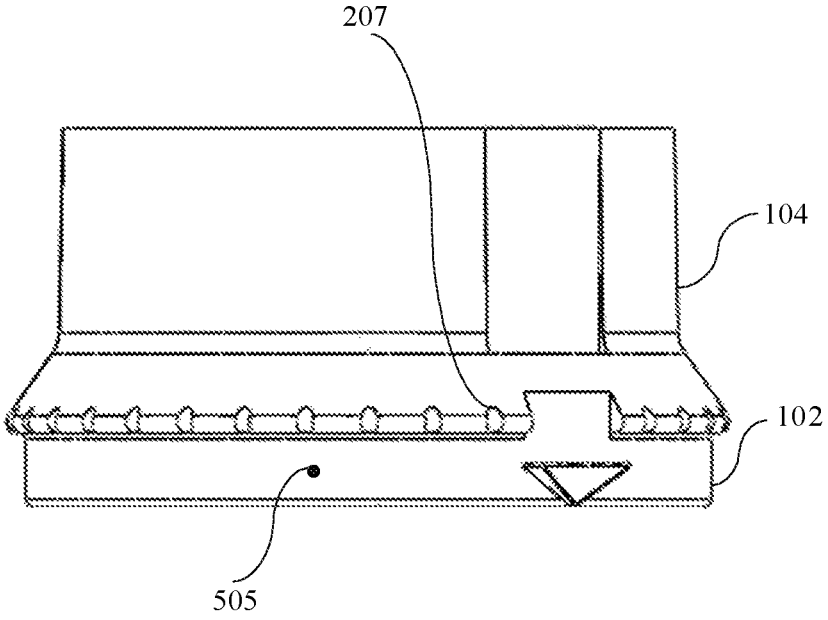
FIG. 1 illustrates a side view of the pill dispensing device, according to one embodiment herein.

Although the specific features of the present invention are shown in some drawings and not in others. This is done for convenience only as each feature may be combined with any or all of the other features in accordance with the embodiments herein.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a device for dispensing pills. The device comprises one or more dispensing chambers configured for molding into the bottle rim, or fastening inside or outside of the bottle. The dispensing chamber includes a plurality of radial projections projecting inwardly from an inner circumference of the dispensing chamber. The radial projections define discrete pill holding areas. The pill dispensing device also comprises a dispensing cap secured to and rotated either uni-directionally or bi-directionally to the one or more dispensing chambers, having a base with a window formed there through. The window is selectively positioned opposite the pill holding areas. The dispensing cap comprises uneven surfaces on the cap's holding surface thereby providing the pills in the dispensing chambers to oscillate up and down to cause the mixing/turbulent action. The dispensing cap is mounted outside the bottle. The pill dispensing device further comprises a rotating central hub formed on an inner side of the base for delimiting an inner boundary of the pill holding areas. The dispensing cap is rotated to locate the window in alignment with successive pill holding areas. When the bottle is inverted or angled upside-down, a pill in one of the pill holding areas falls through the window when the window is positioned opposite to the pill holding areas.

According to an embodiment herein, the dispensing cap is provided with a bisecting hinge or a butterfly hinge to provide a lid with a smaller profile or to allow the lid to have a smaller lid profile and to partially open the lid during a dispensing action.

According to an embodiment herein, the hinge of the dispensing cap is attached either in the middle of the cap (living hinge) or directly opposite to the dispensing door (butterfly hinge).

According to an embodiment herein, the dispensing cap is provided with a low resistance child proof mechanism to prevent a child to gain access to the entire contents of the bottle.

According to an embodiment herein, the dispensing cap is rotated in either clockwise or counter-clockwise direction to facilitate the cap to be used with any standard bottle/container.

According to an embodiment herein, the dispensing cap is configured for dispensing multiple pill forms including tablets and caplets, geltabs and gelcaps and the like.

According to an embodiment herein, the dispensing cap is configured for mounting outside with a Calmar snap fit or by continuous thread to achieve a hermetic seal on the bottle.

According to an embodiment herein, the dispensing cap is provided with continuous threads for easy removal of the cap with a traditional press and turn action.

According to an embodiment herein, the dispensing cap is provided with vertical lock ramps to achieve a pronounced tactile feel when a cap rotation is completed and to provide an audible click/tap sound and a vibration feel when the outer and inner caps are aligned to dispense.

According to an embodiment herein, the dispensing cap comprises a beveled edge seal rim positioned around the inside of the outer cap which is pressed into and against the inner cap's sealing sleeve/ridge to reduce exposure of the contents inside the container to air and moisture.

According to an embodiment herein, the dispensing cap further comprises a cover hingedly attached to the base for covering the outside of the base and the window. The ambient air is substantially prevented from entering the bottle. The hinge is a bisecting hinge or a butterfly hinge.

According to an embodiment herein, the pill dispensing device comprises ratcheting ribs arranged inside the dispensing cap's rim that is configured to lock around the dispensing chamber when the dispensing cap is squeezed.

According to an embodiment herein, the dispensing chamber further comprises a plurality of claws respectively extending below the pill holding areas.

According to an embodiment herein, the pill to be dispensed is a measured dose of a loose powder or granulated substance.

According to an embodiment herein, the central hub is configured to be rotated inside the dispensing chamber to reduce the total number of parts/operating components in the pill dispensing device.

FIG. 1 illustrates a side view of the pill dispensing device, according to one embodiment herein. With respect to FIG. 1, the pill dispensing device 100 includes a dispensing cap 102 secured to and rotatable either uni-directional or bi-directional to one or more dispensing chambers 104 based on user preference or usage. The dispensing chambers 104 is molded into the bottle rim, fastened inside of the bottle rim or fastened outside of the bottle by a "Calmar" snap fit or by typical continuous threads (not shown) on inner surface to secure the dispensing device 100 on any standard bottle. In one example embodiment, the dispensing chamber 104 is configured for an outside mount to a Calmar or threaded standard bottle so that a hermetic seal is achieved on the bottle. The outside mount allows the sorting and dispensing components to be held away from the plane where foil seal is attached to the bottle mouth opening. This hermetic seal increases the shelf-life of the contents of bottle. The dispensing chamber 104 thus fastened using continuous threads enables the removal of the pill dispensing device 100 using a traditional press and turn action.

Figure 2:
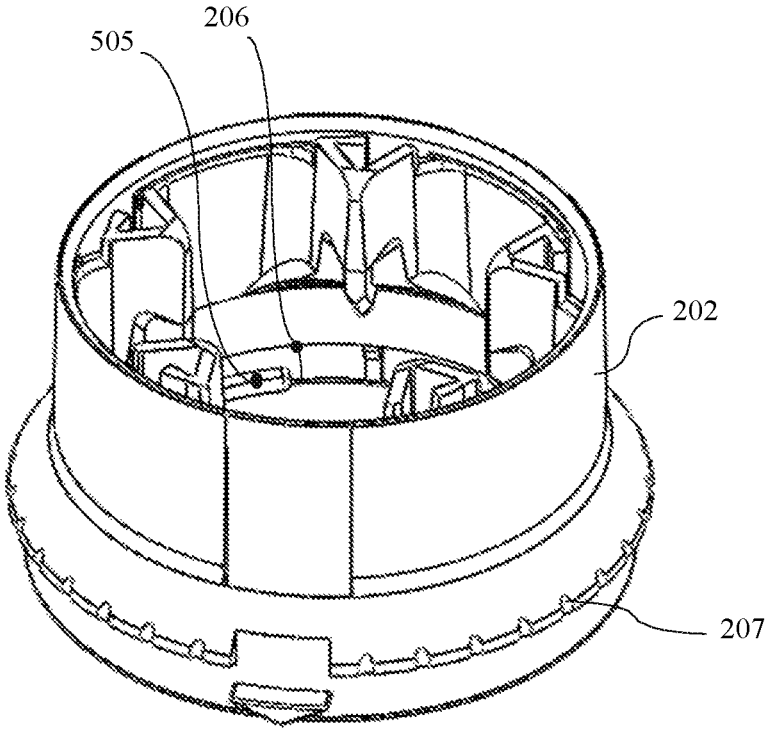
FIG. 2 illustrates a perspective view of a dispensing chamber of the pill dispensing device, according to one embodiment herein.

FIG. 2 illustrates a perspective view of a dispensing chamber of the pill dispensing device, according to one embodiment herein. With respect to FIG. 2, dispensing chamber 104 is configured for molding into the bottle rim or fastening inside or outside of any standard pill bottle. Alternatively, dispensing chamber 104 can be made integral with a pill bottle as one piece of molded plastic. Dispensing chamber 104 includes an outer circumferential surface 202 which fits within the upper portion of bottle. An upper flange sits upon or engages the lip or rim of bottle and ensures that dispensing chamber 104 does not slip down into the bottle.

According to an embodiment herein, bevelled edge seal rim 206 is used around the inside of the dispensing cap/inner cap 102 which presses into and against the dispensing chamber/outer cap 104 sealing sleeve/ridge to reduce exposure of the contents inside the container/bottle to air and moisture. In one embodiment, the outer cap also has stabilizing ribs on the inside surface that stabilize the cap on the dispensing chamber. There are also provided ratcheting ribs 208 inside the outer cap's rim that lock around the inner cap when the outer cap is squeezed. This feature assists in removal of the dispensing device from the bottle.

According to an embodiment herein, dispensing chamber 104 is shown as fitting around the entire rim of the bottle, however it may also be formed as a half-circle, partial-circle, or similar arcuate shaped element without departing from the scope of the invention.

Figure 3:
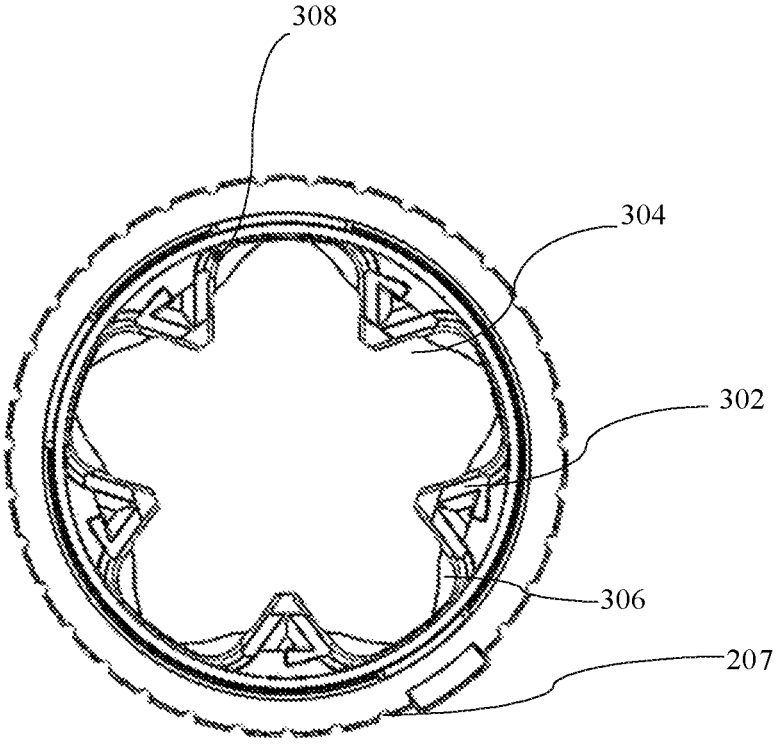
FIG. 3 illustrates a top view of the dispensing chamber of the pill dispensing device, according to one embodiment herein.
Figure 4:
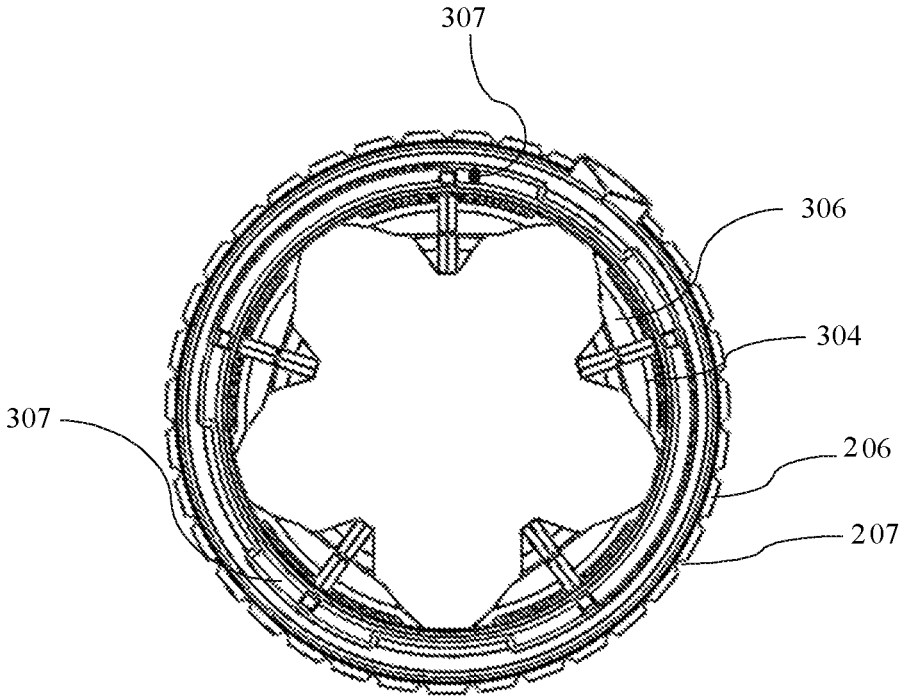
FIG. 4 illustrates a bottom view of the dispensing chamber of the pill dispensing device, according to one embodiment herein.

FIG. 3 and FIG. 4 illustrate a top and bottom views of the dispensing chamber of the pill dispensing device, according to one embodiment herein. With respect to FIG. 3 and FIG. 4, a plurality of radial projections 302 formed on the inner circumference 304 of the dispensing chamber 104 project inwards, and between adjacent radial projections 302 are defined discrete pill holding areas 306. The width of a pill holding area 306 (e.g., the distance between facing side walls of adjacent radial projections) is preferably only slightly larger than the width of a pill or dosage, e.g., two pills, in the container. As the bottle is turned or angled upside-down, for pill dispensing, pills will fall into pill holding areas 306, one pill or dosage per area.

Figure 5:
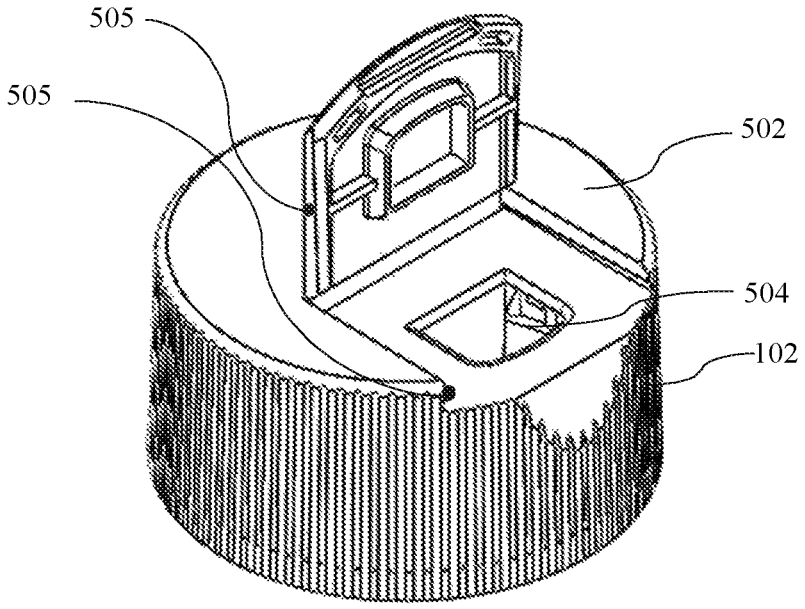
FIG. 5 illustrates a perspective view of the dispensing cap of the pill dispensing device, according to one embodiment herein.

FIG. 5 illustrates a perspective view of the dispensing cap of the pill dispensing device, according to one embodiment herein. With respect to FIG. 5, the dispensing cap 102 is provided with a pill-impermeable base 502 having a window 504 formed there through. The single pill-width window 504 is selectively, rotatively positionable opposite the pill holding areas 306 of the dispensing chamber 104. The rotation of the dispensing cap 102 locates the window 504 in alignment with successive pill holding areas 306.

Figure 6:
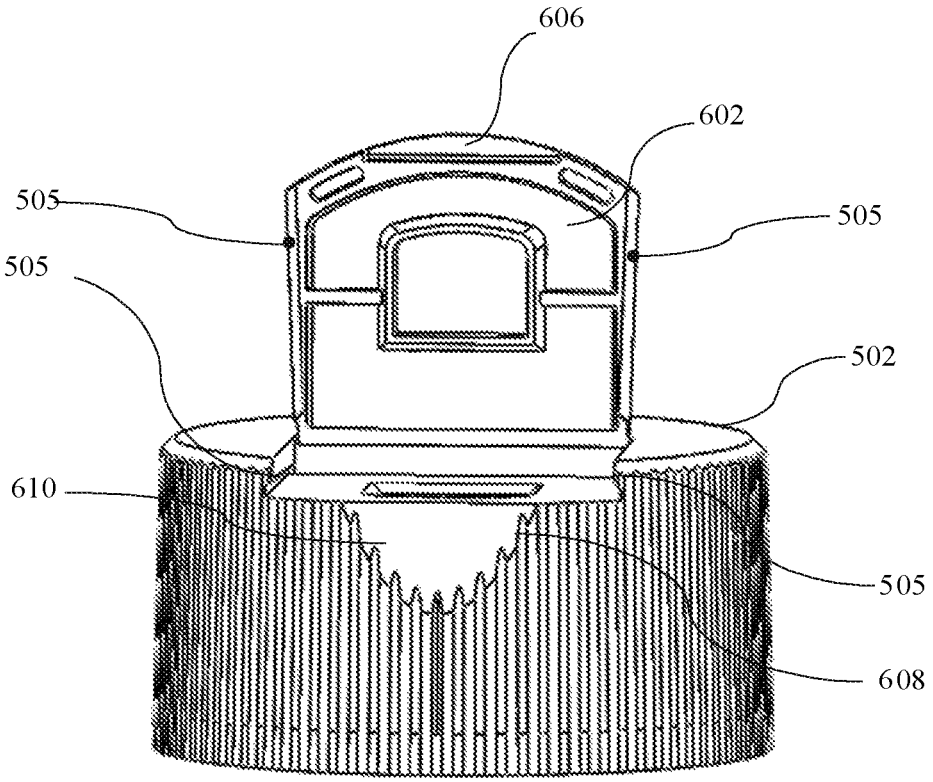
FIG. 6 illustrates a side view of the dispensing cap of the pill dispensing device, according to one embodiment herein.
Figure 7:
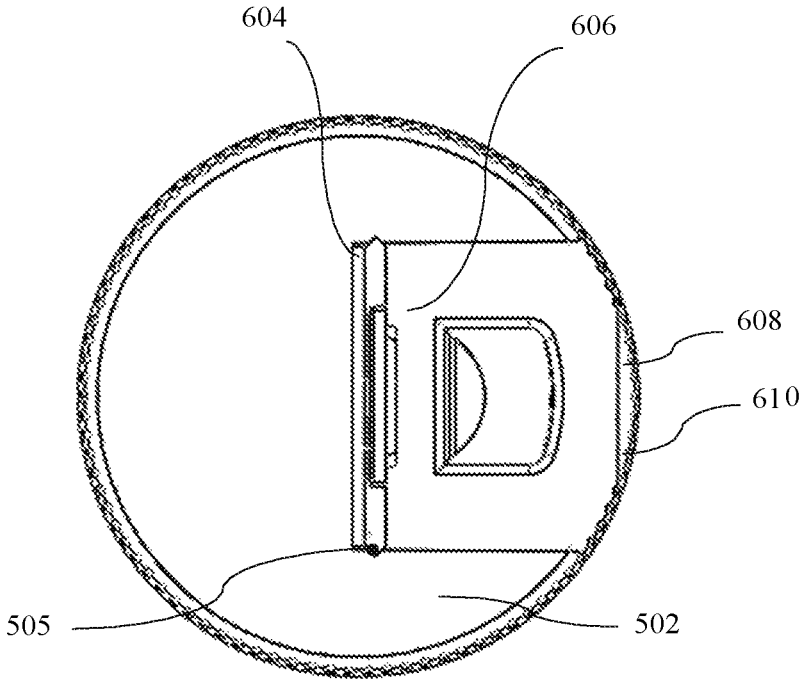
FIG. 7 illustrates a top view of the dispensing cap of the pill dispensing device, according to one embodiment herein.

FIG. 6 and FIG. 7 illustrate a side and top views of the dispensing cap of the pill dispensing device, according to one embodiment herein. With respect to FIGS. 6 and 7, a cover 602 is attached to the base 502 of the dispensing cap 102 via a hinge 604 for covering the top of the base 502 and thus window 504, thereby preventing ambient air and its associated contaminants from entering the bottle and ruining its contents. The cover 602 includes a locking tongue 606 which mates with circumferentially extended tab 608 and frictionally fits into slot 610 between tab 608 and base 502 of cap 102. This serves as a child safety mechanism.

According to an embodiment herein, the cover 602 on the dispensing cap 102 may be a flip up action or a press-in and up action. The press-in and up release method involves a small thumb-sized section in the side of the cap to be part of the lid. This type press-in and up lid is the secondary child-safety feature whereas the primary child safety feature is inherent to the mechanical manipulation of the dispensing cap 102.

According to an embodiment herein, the hinge used in this case is either a bisecting hinge or a butterfly hinge. The bisecting hinge is a living hinge type that allows for a smaller lid/cover profile and enables the lid to be partially open while dispensing. This lower profile is more ergonomic and preferable than any other hinges such as the 180 degree opposing hinge. The bisecting hinge requires a slide pull component in the steel mold which requires three components in the steel mold. In comparison, the butterfly hinge allows the cover to swing open and is held in an open position due to the elastic properties of the butterfly hinge. The butterfly hinge only requires two pieces in the steel mold which in-turn makes the production of the pill dispensing device less expensive. The hinge of the cover may be in the middle of the cap (living hinge) or directly opposite of the dispensing door (butterfly hinge).

Figure 8:
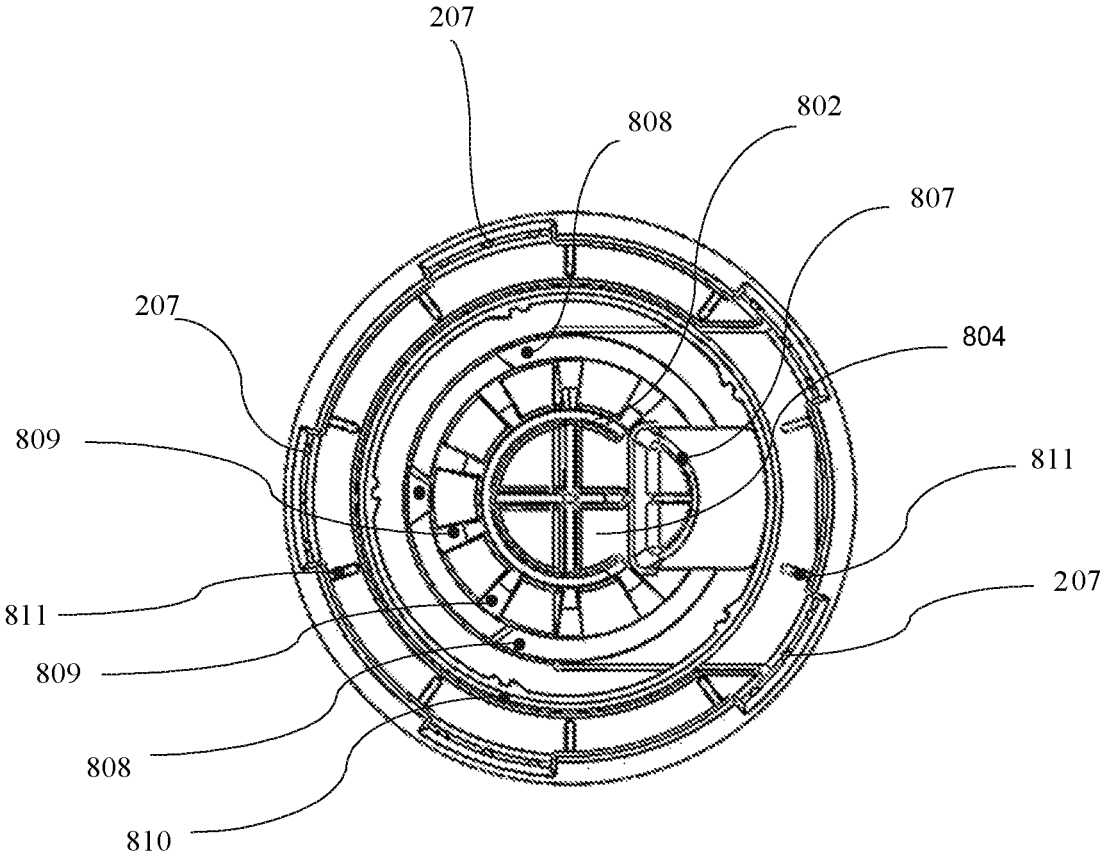
FIG. 8 illustrates a bottom view of the dispensing cap of the pill dispensing device, according to one embodiment herein.

FIG. 8 illustrates a bottom view of the dispensing cap of the pill dispensing device, according to one embodiment herein. The dispensing cap 102 includes a rotatable central hub 802 formed on the inner side or underside of the base 502. The central hub 802 being rotatable in-turn reduces the total number of operational parts required for the pill dispensing device. The central hub 802 delimits an inner boundary of the pill holding areas 306 which are otherwise only defined by radial projections 302 of dispensing chamber 104. The two adjacent radial projections 302 formed on the inner circumference of the dispensing chamber 104 and central hub 802 preferably define a set area/volume which can contain one pill or dosage.

According to an embodiment herein, the central hub 802 may be conical, frusto-conical, pyramidal, cylindrical, or of similar geometry, With respect to FIG. 8, central hub 802 includes a central raised portion 804 which substantially comes to a point at its center. The raised portion 804 helps guide pills into pill holding areas when the bottle is inverted. Raised portion 804 may be made from multiple inclined ribs, as shown in FIG. 8 or it may be conical, frusto-conical, pyramidal, or the like (but preferably tapered).

According to an embodiment herein, the dispensing cap 102 is configured to have vertical rotation lock ramps 806. The vertical rotation lock ramps 806 provide a more pronounced tactile feel when cap rotation is complete and avoid over-rotation and thereby avoids dispensing more than required quantity. The dispensing cap 102 slightly moves up/off of the dispensing chamber 104 when rotating and settles down/when rotation is complete. This up-down or off-on oscillation applies to rotations in either direction and can be used with both the snap-on and threaded versions of the proposed pill dispensing device. When the dispensing cap is rotated it causes the pawl of the cap to push against the edge of the wall which deflects the holding plate provided in the cap. Once the pawl is through with its cycle, the holding plate snaps back into its position, ready to turn the next chamber in-turn causing realignment shaking or vibration of the pills. This facilitates the mixing of the pills such that they fall into empty chambers. In one embodiment, a rotating holding plate is used which does not require any modifications to the existing bottles and reduces the number of parts needed and utilizes any standard bottle. In one embodiment, a rotating gate is provided with the rotating hub in order to reduce production complexity and to save on cost.

According to an embodiment herein, the vertical lock rotation ramps 806 may be configured to allow an audible click/tap sound and a vibrational feel when the dispensing cap and dispensing chamber are aligned to dispense. These vertical locks also serve as the interlocking teeth that engage when unscrewing the dispensing cap 102 from the bottle during the press and turn action as part of the child safety system. In one example embodiment, the vertical locks also serve as "Plate Tumblers" that cause agitation of the pills as they ride up and down on the vertical locks. The pill dispensing device uses uneven surfaces on the dispensing cap's holding surface (Vertical rotation lock ramps) that cause pills in the dispensing chambers 104 to oscillate up and down to promote a the mixing/turbulent action.

According to an embodiment herein, different types or shapes of the outer cap can be incorporated into the design of the proposed invention. In one example embodiment, the outer cap is made with a rubber impregnated plastic surface or in a knobby shape for easy gripping by the elderly.

According to an embodiment herein, the device allows for cotton to be used to reduce moisture in the bottle. The geometric shape of the central hub ensures that cotton does not get into the dispensing chambers to cause any fouling in the dispensing action which eliminates the need of desiccant can in the design.

Therefore, the pill dispensing device offers several advantages as compared to the existing pill dispensing devices. The existing versions allow for dispensing in only one direction while the proposed invention allows for dispensing in both directions or can also be uni-directional depending on the preference/usage, thus any standard bottle can be used with the pill dispensing device. The device make use of a bisecting or butterfly hinge which allows for a smaller lid profile and enables lid to be partially open while dispensing which is more ergonomic and preferable as far as dispensing devices are concerned. The use of butterfly hinge in the design requires only two pieces in the steel mold as compared to the five to eight piece designs of the existing devices which makes production less expensive and also reduces the overall usage of plastic material.

Further, the device uses outside mount of the dispensing cap which allows the sorting and dispensing components to be held away from the plane where foil seal is attached to the bottle mouth opening. This helps to achieve a hermetic seal on the bottle which is critical for shelf life and shipping of pharmaceutical products. The device allows for a continuous threaded dispensing cap which can also be removed with a traditional press and turn action. This device is configured to be mated to a more widely used bottle types which in-turn helps in reducing the costs and for mass production as threaded bottles are widely available.

The dispensing device also facilitates mixing/turbulent action of the contents before dispensing with the help of uneven surfaces on the cap's holding surface (Vertical Rotation Lock Ramps) that cause pills in the chambers to oscillate up and down. This device also incorporates a beveled edge seal rim around the inside of the outer cap. This presses into and against the inner cap's sealing sleeve/ridge to reduce exposure of the contents inside the container to air and moisture. Also, the existing dispensers use a separate child lock component which is a small arc segment that the user needs to slide/rotate over the dispenser lid. This is eliminated in the proposed invention and an optional press-in release tab is incorporated into the lid.

The specialized dispensing bottle cap of the proposed invention is used in over the counter or prescription bottles. It is also used for products that cannot come into contact with human hand such as water treatment tablets. It is used for any application involving a capsule, tablet or powder form required for treatment of the human body, any industrial or environmental application. Thus, the device allow for multiple pill forms to dispense including: tablets and caplets, geltabs and gelcaps with the same dispenser which cuts down on production required for different pill sizes.

The pill dispensing device has a consumer familiar aesthetic appearance which helps to initiate consumer trust and is more effective in marketing the product. The material used for the pill dispensing device is polypropylene due to its inert characteristics, low cost, recyclable, rigidity, flexibility and elasticity which provides the best material features. The bottle is a standard "Calmar" snap or standard continuous thread made of high density polyethylene material which is also inert and inexpensive and recyclable. The use of these materials makes the dispenser reusable. By being reusable and recyclable reduces waste stream which makes the product environment friendly.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be the to fall there between.

What is claimed is:

1. A device for dispensing pills comprising:

one or more dispensing chambers, and wherein the one or more dispensing chambers are configured to be mounted outside the bottle, and wherein each dispensing chamber of the one or more dispensing chambers includes a plurality of radial projections, and wherein the plurality of radial projections are configured to project inwardly from an inner circumference of each dispensing chamber, and wherein the plurality of radial projections are configured to define or disclose a plurality of discrete pill holding areas;

a dispensing cap, secured to each dispensing chamber of the one or more dispensing chambers, and wherein the dispensing cap is rotated unidirectionally or bidirectionally, and wherein the dispensing cap has a base provided with a window formed there through, and wherein the window is selectively positioned opposite to any one of the plurality of discrete pill holding areas and wherein the dispensing cap comprises uneven surfaces on a holding surface to enable or allow a plurality of pills stored in the one or more dispensing chambers to oscillate up and down to generate a mixing/turbulent action, and wherein the dispensing cap is mounted outside the bottle, and wherein the dispensing cap is configured for dispensing a pill in a plurality pill forms, and wherein the plurality of pill forms includes tablets and caplets, geltabs and gelcaps, and wherein the dispensing cap comprises a beveled-edge cylindrical sleeve seal rim positioned around the inside of an outer cap, and wherein the cylindrical sleeve seal rim is configured to press into and against an inner cap's inner circumference to reduce exposure of the contents inside the container to air and moisture, and wherein the cylindrical sleeve seal rim is configured to contact the inner cap's inner circumference and wherein a plurality of ratcheting ribs is arranged inside a dispensing cap's rim to lock around the dispensing chamber when the dispensing cap is squeezed, and wherein the plurality of ratcheting ribs are configured to be positioned vertically or longitudinally along an inner circumference of the outer cap and these plurality of ratcheting ribs are configured to allow the outer cap to lock around the inner cap when the outer cap is squeezed which assists in removal of the dispensing device from the bottle;

a rotating central hub formed on an inner side of the base for delimiting an inner boundary of the plurality of pill holding area wherein the central hub is provided with a plurality of vertical deflection fins, and wherein the plurality of vertical deflection fins are arranged at equal distances around a circumference of the central hub, and wherein the rotating central hub is configured to be rotated inside the dispensing chamber to reduce a total number of operating components in the device, and wherein the rotating central hub is provided with a rotating holding plate or a rotating gate is provided to reduce the total number of components required to reduce a production complexity thereby saving a cost of manufacturing; and wherein the dispensing cap is rotated to locate the window in alignment with the plurality of pill holding areas successively, and a pill stored in one of the plurality of pill holding areas falls through the window, when the window is to one of the plurality of pill holding areas, and the bottle is inverted or angled upside down, and wherein the dispensing cap is provided with a bisecting hinge or a butterfly hinge to provide the cap with a smaller lid profile and to partially open the lid during a pill dispensing action/process, and wherein the gate has a vertical semicircular extension configured for blocking additional pills from entering each dispensing chamber.

2. The pill dispensing device according to claim 1, wherein the bisecting hinge or a butterfly hinge of the dispensing cap is attached either in the middle of the cap (living hinge) or directly opposite to the dispensing door (butterfly hinge).

3. The pill dispensing device according to claim 1, wherein the dispensing cap is provided with a child proof mechanism to prevent a child to gain access to entire contents of a dispensing bottle.

4. The pill dispensing device according to claim 1, wherein the dispensing cap is rotated in either clockwise or counter clock direction to facilitate the cap to be used with any bottle/container.

5. The pill dispensing device according to claim 1, wherein the dispensing cap is provided with a plurality of vertical lock ramps to achieve a pronounced tactile feel when cap rotation is completed, and wherein the plurality of vertical lock ramps are provided to generate an audible click/tap sound and a vibration feel when the outer and inner caps are aligned to dispense.

6. The pill dispensing device according to claim 1, wherein the dispensing cap further comprises a cover hingedly attached to the base for covering the outside of the base and the window, to prevent an entry of ambient air into the bottle, and wherein the hinge is a bisecting hinge or a butterfly hinge.

7. The pill dispensing device according to claim 1, wherein the dispensing chamber further comprises a plurality of claws and wherein the plurality of claws are respectively extended below the plurality of pill holding areas.

8. The pill dispensing device according to claim 1, wherein the pill to be dispensed is a measured dose of a loose powder or granulated substance.

* * * * *